United States Patent [19]

Walker et al.

[11] 4,090,167

[45] May 16, 1978

[54] PUSH SWITCH AND POTENTIOMETER ASSEMBLY

[75] Inventors: Jerry L. Walker, Euless; Charles R. Crockett, Arlington, both of Tex.

[73] Assignee: Teccor Electronics, Inc., Euless, Tex.

[21] Appl. No.: 763,830

[22] Filed: Jan. 31, 1977

[51] Int. Cl.[2] ..... H01C 10/36

[52] U.S. Cl. ..... 338/172; 338/159; 338/171; 338/198; 338/200

[58] Field of Search ..... 338/159, 162, 167, 171, 338/172, 174, 191, 198, 200, 201; 200/153 L, 153 LB, 156

[56] References Cited

U.S. PATENT DOCUMENTS

| | | | |
|---|---|---|---|
| 3,023,388 | 2/1962 | Girolamo et al. | 338/172 |
| 3,697,921 | 10/1972 | Urwin | 338/172 X |
| 3,949,347 | 4/1976 | Gilbreath | 338/260 X |

*Primary Examiner*—C. L. Albritton

*Attorney, Agent, or Firm*—Hubbard, Thurman, Turner, Tucker and Glaser

[57] ABSTRACT

A potentiometer and switch assembly wherein the potentiometer resistance is deposited on a circuit board. The control member of the assembly comprises a shaft having a rotor mounted thereon, attached to which is a wiper for contacting the resistance. The switch mechanism includes a cam shaft adapted to be engaged by the rotor whenever the control shaft is pushed. The cam shaft is positioned to the side of the rotor and is rotated through a predetermined angle each time the control shaft is pushed. Camming surfaces on the cam shaft contact one member of the switch contact pair to alternately cause that contact pair member to open and close the switch. The cam shaft may be arranged to contact a second switch contact pair which opens and closes oppositely to the first switch contact pair so that a three-way switching function may be effectuated.

6 Claims, 9 Drawing Figures

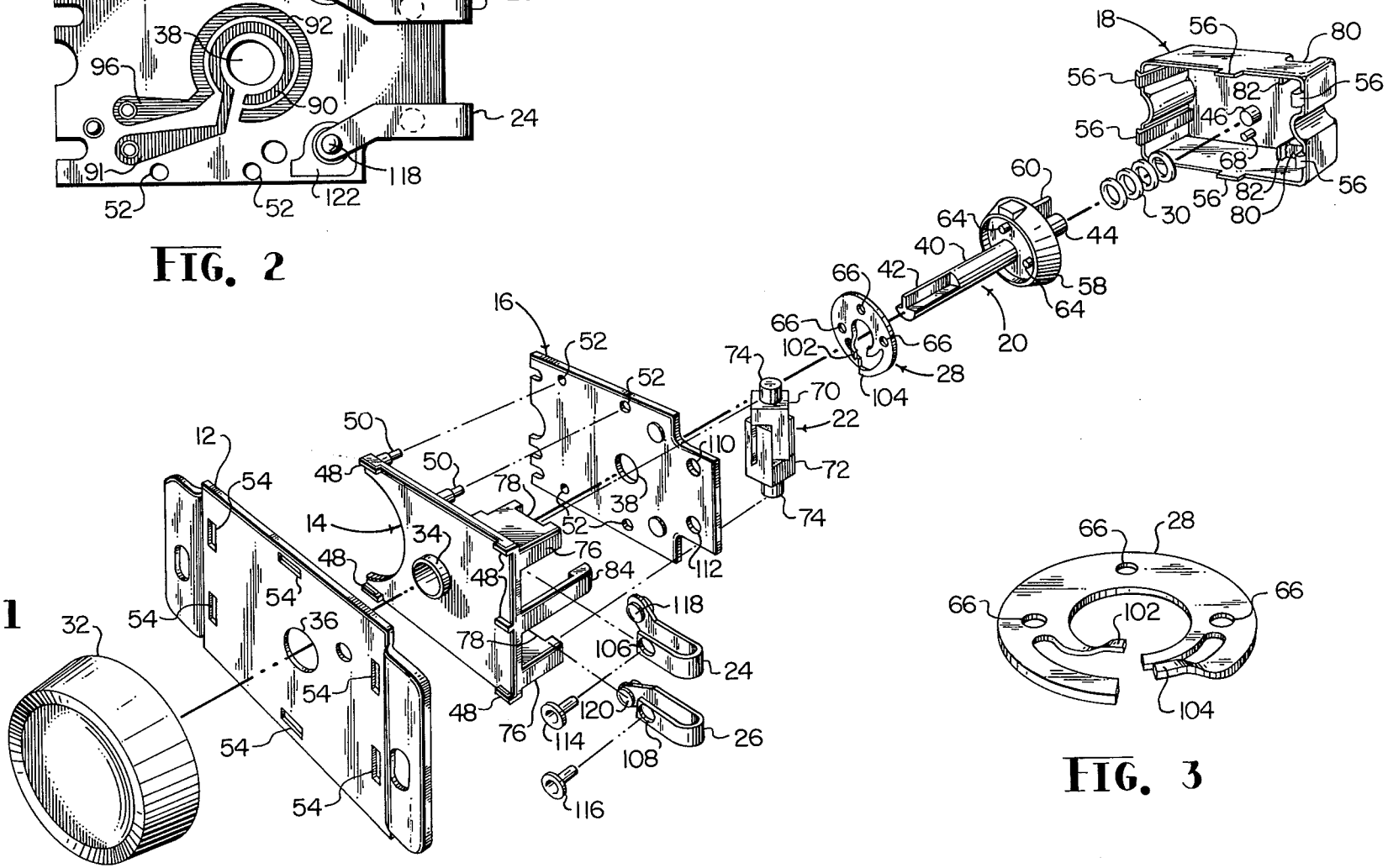
FIG. 1
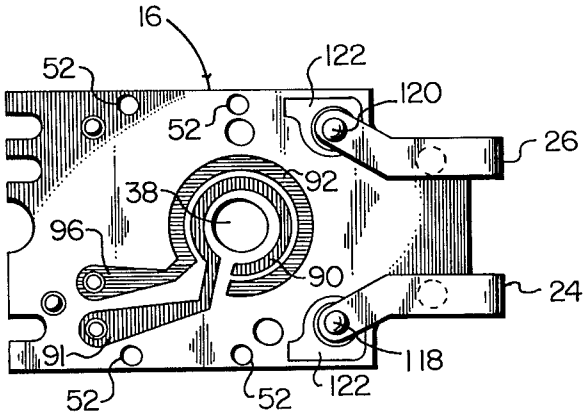
FIG. 2
FIG. 3

PUSH SWITCH AND POTENTIOMETER ASSEMBLY

BACKGROUND OF THE INVENTION

This invention relates to power control circuitry and, more particularly, to an improved push switch and potentiometer assembly therefor.

In conventional power control devices, such as for example, dimming devices for lighting systems or motor speed controls, power control may be achieved by controlling the conduction time of a switching device, commonly referred to as phase control of power. This conduction time is controlled through the use of a potentiometer which is part of the power control circuit connected between the power source and the load. Typical prior art systems have utilized a circular potentiometer enclosed in a relatively bulky housing. The bulkiness of the housing leads to the undesirable result that a significant amount of space is required for mounting the power control unit. Additionally, the added weight of the potentiometer housing leads to increased manufacturing and shipping costs.

One type of power control device utilizes a push switch wherein the switch portion is opened and closed alternately on successive pushes of the control member. Such a switch may be fairly complex mechanically, having a plurality of cams and springs, especially when such a switch is adapted for use as a three-way switch. Additionally, the switch mechanism in such a device is typically behind the control member, adding bulk to the device.

It is therefore an object of the present invention to provide a push switch and potentiometer assembly.

It is a further object of the present invention to provide such an assembly which is compact in size and light weight.

It is another object of the present invention to provide such an assembly of simple construction.

It is yet another object of the present invention to provide such an assembly which may function as a three-way switch.

It is another object to provide such an assembly that the potentiometer resistance is near infinity when the suitable contacts open or close reducing arcing to a negligable level and thusly extending the life of the switch contacts.

Another object of the invention is to provide a push switch and potentiometer assembly having a one piece shaft and rotor facilitating the use of plastic materials by reducing the strength requirements.

Another object of the invention is to provide a push switch and potentiometer assembly especially adapted for use in light dimmers.

SUMMARY OF THE INVENTION

In accordance with the foregoing and additional objects, an improved push switch and potentiometer assembly is provided wherein the potentiometer resistance is deposited on a circuit board. The control member of the assembly comprises a shaft having a rotor mounted thereon, attached to which is a wiper for contacting the resistance. The switch mechanism includes a cam shaft adapted to be engaged by the rotor whenever the control shaft is pushed. The cam shaft is positioned to the side of the rotor and is rotated through a predetermined angle each time the control shaft is pushed. Camming surfaces on the cam shaft contact one member of the switch contact pair to alternately cause that contact pair member to open and close the switch. The cam shaft may be arranged to contact a second switch contact pair which opens and closes oppositely to the first switch contact pair so that a three-way switching function may be effectuated.

DESCRIPTION OF THE DRAWINGS

The foregoing will be more readily apparent upon reading the following description in conjunction with the drawing in which:

FIG. 1 is an exploded perspective view of an improved push switch and potentiometer assembly according to this invention;

FIG. 2 is a plan view of one side of the circuit board of the assembly according to this invention showing the switch contacts and the potentiometer resistance deposited thereon;

FIG. 3 is an enlarged perspective view showing the potentiometer wiper element;

DESCRIPTION OF THE PREFERRED EMBODIMENT

Figure 4:
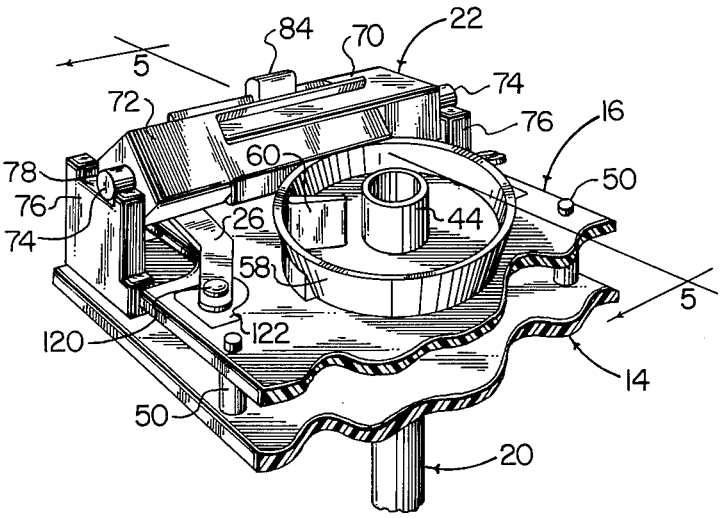
FIG. 4 is an enlarged fragmentary perspective view showing the rotor and cam shaft.

Referring now to the drawings wherein like reference numerals in different figures denote like parts and wherein only such detail as is necessary for an understanding of the present invention is fully illustrated and in particular to FIG. 1, depicted therein is an exploded perspective view of an improved assembly constructed in accordance with the principles of this invention. This switch and potentiometer assembly includes generally a heat sink and mounting plate 12, a spacer plate 14, a circuit board or base 16, a cover member 18, a control member 20, a cam shaft 22, a pair of spring contacts 24 and 26, a potentiometer wiper element 28, a spring 30, and a knob 32. Although not shown therein, the assembly depicted in FIG. 1 may also include electrical circuit components mounted on a circuit board 16.

Spacer plate 14 has formed thereon a stepped cylindrical member 34, the smaller end of which fits through aperture 36 in heat sink and mounting plate 12 and the larger end of which acts as a shoulder which abuts against heat sink and mounting plate 12. Although not shown in FIG. 1, on the other side of spacer plate 14 is a corresponding cylinder member (not stepped) which abuts against circuit board 16. Circuit board 16 has formed therein an aperture 38. Apertures 36 and 38 and cylindrical member 34 are aligned for receiving therethrough shaft 40 of control member 20. Shaft 40 is formed at one end with a key 42 which may be seated into a suitable keyway (not shown) formed within a sleeve forming part of knob 32. A pin 44 at the opposite end of control member 20 from key 42 has an opening therein into which fits pin 46 formed on the inside of cover 18. Compression spring 30 is disposed concentrically over pin 44. Control member 20 is thus mounted for both axial reciprocating and rotational movement in two directions in the assembly, spring 30 urging control member 20 toward circuit board 16.

Spacer plate 14 is formed with a plurality of legs 48 which, along with the shoulder of cylindrical member 34, keep spacer plate 14 a predetermined distance from heat sink and mounting plate 12. Spacer plate 14 is also formed with a plurality of stepped pins 50, the small end of which fit into respective apertures 52 in circuit board 16. Mounting plate and heat sink 12 is formed with a plurality of open slots 54. Cover 18 is formed with a plurality of tabs 56, some of which preferably have lips, which fit through slots 54 in heat sink and mounting plate 12 to secure cover 18 thereto with the assembly thereby being held in fixed spaced relationship.

Control member 20 has a rotor assembly 58 formed on, and concentric with, shaft 40. Abutment 60 formed on rotor 58 cooperates with pin 68 formed on cover 18 to limit the rotational travel of control member 20. Rotor 58 is also formed with pins 64. A plurality of apertures 66 formed in wiper element 28 fit over respective pins 64 to mount wiper element 28 onto rotor 58 of control member 20.

Figure 5:
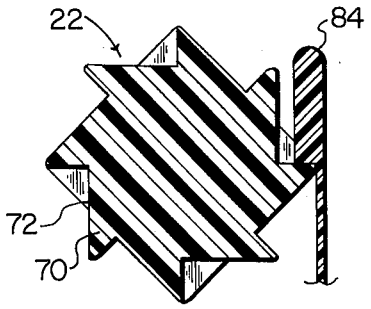
FIG. 5 is a cross-sectional view of the cam shaft taken along the line 5—5 of FIG. 4.

Cam shaft 22 is formed of a pair of blocks 70 and 72 with pins 74 extending from the ends thereof. Blocks 70 and 72 are of generally equal size square cross-sectional configuration and are angularly displaced from each other by an angle of 45°. In the region of intersection of extensions of blocks 70 and 72, the corners of each which extend out past the sides of the other block are cut (as clearly shown in FIG. 5) to form an eight-toothed ratchet in this region of intersection.

Spacer plate 14 has formed thereon a pair of upstanding walls 76 with recesses 78 cut into the ends opposite spacer plate 14. Cover 18 is formed with a pair of internal shoulders 80 each having a pair of walls 82 extending therefrom. Pins 74 of cam shaft 22 are held in recesses 78 by the walls 82 of shoulders 80. This allows cam shaft 22 to rotate and at the same time have a limited degree of movement in a direction transverse to its axis of rotation.

Spacer plate 14 also has formed thereon a pawl 84 which cooperates with the ratchet formed at the intersection region of blocks 70 and 72 of cam shaft 22 to only allow one direction of rotation of cam shaft 22. Additionally, pawl 84 is sufficiently resilient that it urges cam shaft 22 toward rotor 58. As will be described in more detail hereinafter, axial reciprocation of control member 20 causes rotor 58 to engage cam shaft 22 for rotation thereof.

Referring now to FIG. 2, surrounding aperture 38 of circuit board 16 are a pair of arcuately shaped areas 90 and 92 of resistive material which may be deposited on circuit board 16 in a conventional manner, for example, by a screening or other suitable technique. Arcuate areas 90 and 92 are terminated by contact areas 91 and 96, respectively. Arcuately shaped areas 90 and 92 are concentric to aperture 38 and form, in conjunction with wiper element 28 (FIG. 3), a variable resistor which may be utilized as a potentiometer in the improved switch and potentiometer assembly according to this invention. Wiper element 28 is mounted on rotor 58, as described above. Wiper element 28 is made of a conductive material and has a pair of upwardly extending contacts 102 and 104 formed therefrom. Wiper contacts 102 and 104 are adapted to move along resistive portions 90 and 92, respectively. Depending upon the angular position of control member 20, wiper element 28 forms a short circuit across resistive portions 90 and 92, varying the resistance between contact areas 91 and 96. Wiper element 28 is formed of a resilient material so that wiper contacts 102 and 104 are springingly urged against the respective resistive portions 90 and 92.

Besides the potentiometer function, the improved assembly according to this invention functions as a switch. The following discussion will describe the operation of the improved assembly according to this invention as a three-way switch having two contact pairs, it being understood that if only a one-way switching function is desired, only one of the contact pairs will be operatively connected in a circuit. Spring contacts 24 and 26 have apertures 106 and 108, respectively, formed therein. These apertures are aligned, respectively, with apertures 110 and 112 in circuit board 16 and rivets 114 and 116 are utilized to fasten spring contacts 24 and 26 to circuit board 16. At the free end of spring contacts 24 and 26 are button contacts 118 and 120 respectively. Mounted on circuit board 16 are a pair of contacts areas 122 which form the other halves of the contact pairs.

Figure 6A:
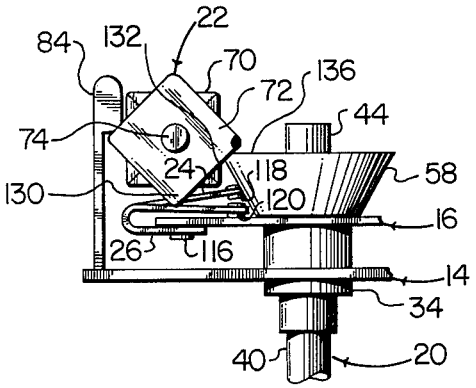
FIGS. 6A–6D are elevation views showing sequentially the operation of the rotor and cam shaft and the alternate closings of the switch contact pairs.
Figure 6B:
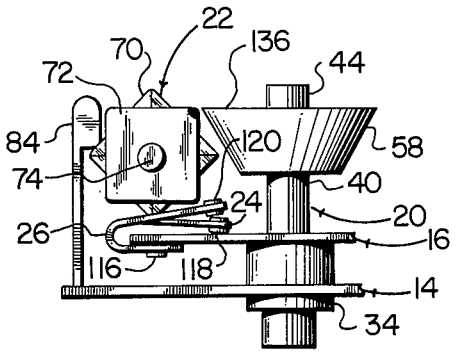
Figure 6C:
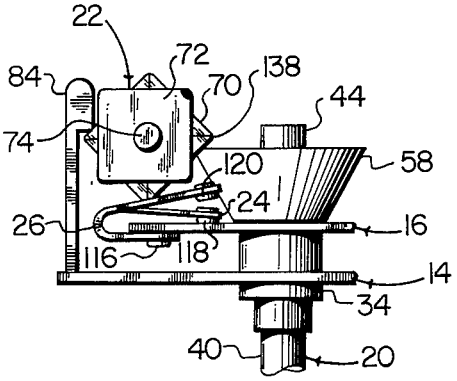
Figure 6D:
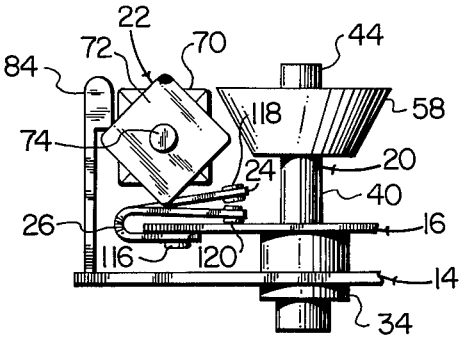

Referring now to FIGS. 6A–6B, the operation of the switch in the approved assembly will be described with reference to the sequence of operation thereof, with one corner of cam shaft 22 being darkened to illustrate the rotation thereof. In FIG. 6A, control member 20 is shown in a rest position. In this position, spring contact 20 is urged down by corner 130 of block 72 so that button contact 120 is in contact with its stationary contact 122 thereby closing a first one of the two switches. At the same time, spring contact 24 is opposite side 132 of block 70 and the resiliency of spring contact 24 opens its corresponding contact pair switch. The next step in the sequential operation of the switch is shown in FIG. 6B where control member 20 is shown after being pushed against spring 30. Returning for a moment to FIG. 6A, in the rest position depicted therein the upper edge 136 of rotor 58 is in engagement with one of the cut corners of block 72. As control member 20 is moved from the rest position shown in FIG. 6A to the position shown in FIG. 6B, the edge 136 of rotor 58 pushes against this cut corner and turns cam shaft 22 one-eighth of a full revolution to the position shown in FIG. 6B. In this new position, spring contact 26 is opposite a side of block 72 and spring contact 24 is opposite a corner of block 70. The switch of which spring contact 24 is a part is now closed and the switch of which spring contact 26 is a part is now open. Referring now to FIG. 6C, when control member 20 is released, spring 30 urges it back to its rest position. Rotor 58 is advantageously frustoconical in shape so that it slides over corner 138 of block 70 as it moves down. This forces cam shaft 22 to the left against pawl 84. As previously described, pawl 84 is resilient and allows this slight movement of cam shaft 22. This movement of cam shaft 22 is permissible since pins 74 are free to move laterally in recesses 78. On this downward travel of control member 20, cam shaft 22 does not rotate. The next rotation of cam shaft 22 occurs when control member 20 is again pushed up, as shown in FIG. 6D. This time upper edge 136 of rotor 58 engages a cut corner 138 of block 70, causing a rotation of cam shaft 22 of one-eighth of a complete revolution. When control member 22 is released and allowed to travel down to its rest position, the position of all the parts will be the same as that depicted in FIG. 6A with the exception that cam shaft 22 has been rotated one-quarter of a full revolution. However, since cam shaft 22 is symetrical, functionally the two positions are identical.

It is thus seen that the two switches are always in opposite states, thus allowing a three-way switching function to be implemented. Additionally, it will be noted that wiper element 28, attached to rotor 58, will be removed from contacting the arcuate resistive portions 90 and 92 before any mechanical switching takes place. This opens the circuit electronically and prevents any arcing in the switch contacts.

It will also be noted that the switching mechanism is to the side of control member 20, rather that above it, as viewed in FIGS. 6A–6D, allowing a lower profile assembly. Furthermore, the construction of the assembly has been advantageously simplified with a minimum of parts. Control member 20 is preferably constructed as a unitary piece of molded plastic. The construction of the present invention wherein the shaft and rotor are a unitary element facilitates the use of plastics material, since mechanical stress is minimal. Support plate 14 is also preferrably of molded plastic and includes as a part thereof both the pawl and a part of the cam shaft support. Cover 18 not only encloses the assembly but also provides part of the cam shaft support as well as a guide pin 46 for control member 20 and pin 68 for limiting the rotation of control member 20.

Although the invention has been shown and described with respect to a single preferred embodiment thereof, it will be understood that various modifications will be obvious to those having ordinary skill in the art and such as come within the spirit and the scope of the invention as defined by the appended claims are considered to be embraced by the present invention.

What is claimed is:

1. A potentiometer and switch assembly comprising:

a base member having a resistive element deposited thereon;

a control member including a shaft porton;

means mounting said control member so that the axis of said shaft portion is normal to said base member for axial reciprocating movement and for rotational movement about said axis;

a wiper element;

means mounting said wiper element on said control member;

resilient means urging said control member in a first axial direction to urge said wiper element into engagement with said resistive element;

a switch including a first contact member fixedly mounted on said base member and a second contact member including an elongated spring mounted at one end on said base member and cantilevered so that its other end is adjacent to said first contact member, said second contact member being self biased out of engagement with said first contact member;

a cam shaft having a plurality of camming surfaces angularly disposed around the axis of said cam shaft, said camming surfaces being of a first type and a second type with the camming surfaces of the first type alternating with the camming surfaces of the second type, the cam shaft being adapted to rotate about its axis to alternately engage the second contact member with one of the first type of camming surfaces and one of the second type of camming surfaces, the camming surfaces of the first type urging said second contact into engagement with said first contact member and the camming surfaces of the second type allowing said second contact member to be self biased out of engagement with said first contact member;

means mounting said cam shaft for rotation about its axis and laterally displaced from said control member; and cam shaft engagement means mounted on said control member for rotating said cam shaft through a predetermined angle whenever said control member is moved in a second axial direction against the urging of said resilient means so that the camming surfaces of the first and second type alternately engage the second contact member each time the control member is reciprocated.

2. The assembly according to claim 1 wherein said cam shaft includes a first end portion, a second end portion and a central portion, the axis of said cam shaft extending through said first end, central and second end portions, the first end portion being a block having a generally square cross-sectional configuration, the second end portion being a block having a generally square cross-sectional configuration of the same size as the first end portion and angularly displaced about said axis by 45° with respect to said first end portion, the central portion being a region of intersection of extensions of the blocks of said first and second end portions, the corners of the block extensions in the central portion being cut so as to allow said cam shaft engagement means to rotate said cam shaft only when said control member is moved in said second axial direction.

3. The assembly according to claim 2 wherein the first type of camming surfaces include the corners of the blocks and the second type of camming surfaces include the sides of the blocks.

4. The assembly according to claim 3 wherein said second contact member of said switch is adjacent said first end portion of said cam shaft, the assembly further including a second switch including a first contact member fixedly mounted on said base member and a second contact member including an elongated spring mounted at one end on said base member and cantilevered so that its other end is adjacent to said first contact member of said second switch, said second contact member of said second switch being self biased out of engagement with said first contact member of said second switch, the second contact member of the second switch being adjacent the second end portion of said cam shaft.

5. The assembly according to claim 2 further including a resilient pawl member mounted so as to engage the central portion of said cam shaft to allow said cam shaft means to rotate said cam shaft when said control member is moved in said second axial direction and to prevent said cam shaft engagement means from rotating said cam shaft when said control member is moved in said first axial direction, said pawl member being mounted on the opposite side of said cam shaft from said cam shaft engagement means so as to urge said cam shaft against said cam shaft engagement means.

6. The assembly according to claim 5 wherein said cam shaft engagement means comprises a frustoconical shaped rotor having its axis aligned with the axis of the shaft portion of said control member, the rotor being oriented with its larger end providing an edge for engaging the central portion of said cam shaft independent of the angular position of the control member about its axis.

* * * * *